US009643753B2

(12) United States Patent
Kinaya et al.

(10) Patent No.: US 9,643,753 B2
(45) Date of Patent: May 9, 2017

(54) ADJUSTABLE BASE DEVICE, SYSTEM AND METHOD OF USE

(71) Applicants: Christopher Anthony Kinaya, West Bloomfield, WI (US); Patrick Kinaya, West Bloomfield, WI (US); Matthew Kinaya, West Bloomfield, WI (US)

(72) Inventors: Christopher Anthony Kinaya, West Bloomfield, WI (US); Patrick Kinaya, West Bloomfield, WI (US); Matthew Kinaya, West Bloomfield, WI (US)

( * ) Notice: Subject to any disclaimer, the term of this patent is extended or adjusted under 35 U.S.C. 154(b) by 0 days.

(21) Appl. No.: 14/487,339

(22) Filed: Sep. 16, 2014

(65) Prior Publication Data

US 2016/0075474 A1 Mar. 17, 2016

(51) Int. Cl.

| | |
|---|---|
| ***B65D 25/24*** | (2006.01) |
| ***B65D 21/08*** | (2006.01) |
| ***A47G 19/30*** | (2006.01) |

(52) U.S. Cl.

CPC ..... *B65D 21/08* (2013.01); *A47G 19/30* (2013.01)

(58) Field of Classification Search

CPC .... B65D 21/0233; B65D 25/24; B65D 21/08; B65D 21/02; A47G 19/30

USPC .... 220/629, 630, 676, 656, 4.03, 4.07, 4.26, 220/23.87, 23.9; 221/279

See application file for complete search history.

(56) References Cited

U.S. PATENT DOCUMENTS

| | | | | |
|---|---|---|---|---|
| 1,468,808 A * | 9/1923 | Hamilton | B65D 23/001 215/12.1 |
| 5,910,162 A * | 6/1999 | Harbour | A47F 3/0439 220/629 |
| 7,497,348 B2 * | 3/2009 | Johnson | B01F 9/0001 220/324 |
| 8,556,106 B1 * | 10/2013 | Bayat | B65D 43/0229 220/254.8 |
| 2008/0149661 A1 * | 6/2008 | Sines | B65D 21/08 221/279 |

* cited by examiner

*Primary Examiner* — Fenn Mathew
*Assistant Examiner* — Don M Anderson
(74) *Attorney, Agent, or Firm* — Kohn and Associates PLLC

(57) ABSTRACT

The invention herein relates to a container device and system with an adjustable base and a method of adjusting said base within said container. The device is comprised of a hollow container, a platform and a rotating key with slit opening. The key is nested between the container and the platform wherein the slit opening of the key is sleeved over protrusions extending from the platform. The protrusions interconnect with the container by matching threaded linings along their contacting surfaces. Rotation of the key causing the platform to move in the same direction along its threaded connection with the container, and therefore lateral movement along the length of the container by travel along said threaded lining.

5 Claims, 4 Drawing Sheets

ADJUSTABLE BASE DEVICE, SYSTEM AND METHOD OF USE

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

CROSS REFERENCE TO RELATED APPLICATIONS

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark office, patent file or records, but otherwise reserves all copyright rights whatsoever.

BACKGROUND OF THE INVENTION

Field of the Invention

The disclosed invention herein pertains to an adjustable base device and system, particularly a device and system wherein a base is raised and lowered by rotating key means.

Background

Serving containers, particularly those containing prepared food in public view, should consider public perception of the products contained therein. Containers of this type interfacing in a public way are often found in open kitchen style restaurants or in intimate domestic settings. Open kitchen style restaurants, such as sandwich shops, buffet and self serve restaurants derive commercial value and sales from public perception of food presentation. Not only is a fresh presentation critical to the viability of such an establishment, it is also subject to regulation. In private use, when entertaining guests, food presentation is equally important. The desire of a guest or invitee to purchase or consume food held within an open container will depend on their perception of the quality and freshness of that food. As such, the aesthetic presentation of products held within an open container is a necessary quality and feature of an affective container device and system.

An existing and unsolved problem in the industry regards the fluctuation of volume in a given food container and how that may drive or detract from a perception of quality. The typical container used in establishments such as sandwich shops or bars are simply square or rectangular in shape with no adjustable base feature. As food is being depleted from a container, the food assembler or restaurant server would have to continually replenish the container with new material in order to create a perception of fullness and freshness. Any gap between refill leaves the container looking partially full or near empty. If the time between refill is extensive, the food held within will begin to look aged even if it is still edible. Poor perception negatively impacts and drives down sales, pushing away potential customers. When this problem becomes a consistent pattern for a business, it begins to impact reputation in irreversible ways. There is a need in the industry to enable restaurant staff to manage the fill perception of a container in public view in order to maintain the attention of their guests, consistency in presentation and standard of their reputation.

The prior art addressing this specific issue are few and inadequate. Those devices that allow a user to adjust perception of volume without continual refill typically provide a container with a floating base centrally attached to a stem or handle. The handle tends to be embodied in a vertical stick protruding from or through the center of the floating base, interconnecting with the base and causing both elements to move together. The stick protrudes sufficiently upward or outward from the container to be accessible by the user's hand. Lifting the base would require the user to pull the handle upward, raising the handle and the floating base. Although the base is effectively lifted, so is the stem further above the top of the container. The stem being attached centrally to the base detracts from usable surface area of the base, affecting the way in which and the amount of material held therein. An alternative embodiment would have the stem protruding from the side of the container. However, this would result in a vertical slit through the container, eliminating the ability for the container to hold flowable material. In this case, the slidable stem to the side of the container not only takes away usable space from the side perimeter of the container, but also is difficult to access if the container is placed adjacent to other products. As such, the concept of a floating adjustable base that is moved by an attached stem or handle is not a practical solution to the problem highlighted herein.

There is currently no container having a vertically adjustable base that provides an illusion of continual fullness, with maximum usable surface area on the base, is easy to handle, satisfies FDA sanitary regulation, and has no above surface protrusion that would otherwise impede or detract from the work area.

SUMMARY OF THE INVENTION

The invention herein relates to a container device and system with an adjustable base and a method of adjusting said base within said container. The device is comprised of the following core elements: a hollow container, a platform and a rotating key. The hollow container is comprised of one or more first surrounding wall defining the hollow space or cavity within. The first surrounding wall being defined by an internal surface and external surface, a top and bottom exposed edge. The internal surface of the first surrounding wall is threaded around its cross section along its length.

The rotating key is embodied in the form of a second surrounding wall. The second surrounding wall fitting within said first surrounding wall, having an internal surface and external surface. The external surface of the second surrounding wall faces the internal surface of the first surrounding wall. The internal surface of the second surrounding wall faces the hollow space within the hollow container. The second surrounding wall is cut through at one or more locations, providing one or more slit openings along its length.

The platform comprises a top and bottom surface, a central area and a rim edge. The diameter of the central space is equal to or less than the cross sectional space of the hollow internal space within the second cylinder wall. The platform comprises a rim edge that is located at its furthest edge in contact with the first and second cylinder wall. The platform also having protrusions that extends laterally from its rim edge. The rim edge further having a surrounding side surface perpendicular to the top surface of the platform. The surrounding side surface at the location of the protrusion is threaded lengthwise from top surface to bottom surface, matching the threading of the first cylinder wall in an interconnecting manner.

The platform may have one or more protrusion extending outward from its rim edge. The slit opening of the second surrounding wall is sleeved over each protrusion such that the surrounding side surface at each protrusion interconnects with the internal surface of the first surrounding wall by their respective threading. The second surrounding wall is nested between the first surrounding wall and the platform wherein the slit opening is sleeved over the protrusion.

The method herein provides for a way to adjust a platform within a container by rotating handle or key as oppose to a lifting handle. The method herein comprising the three part container system defined above wherein a platform may be raised or lowered along the length of a container by rotating the second surrounding wall in either clockwise or counter-clockwise direction around its cross sectional plane, causing the slit opening to move in the rotating direction of the second surrounding wall. This would cause the protrusion, which is sleeved through the slit opening, to move in the rotating direction of the second surrounding wall. The platform is raised or lowered within the hollow cavity of the container along its length as the threading of the surrounding side edge of the protrusion travels along the threading of the internal surface of the first surrounding wall according to the rotation of the second surrounding wall.

This system of adjusting a base of a container by a rotating key element may be applied to more than simply a container in the restaurant business as discussed above. It may be an improvement and alternative method to other similar mechanized applications such as the traditional squeeze tube for cookie dough dispensers. Other embodiments may be in the area of separating materials through filter process wherein the container may be in the form of a cylindrical tube wherein one end is attached to a mesh cover. The second end of the cylinder tube may have an attachment to allow the user to easily rotate the second surrounding wall (rotating key), causing the base to move downward towards the first end and the mesh cover. As the materials held within are pushed forward, it is squeezed against the mesh cover, causing a separation of material held therein based on size or form. This type of application may be used in a wide variety of industry from food preparation to cleaning laundry wherein water is squeezed out of wet clothing. Alternatively, the central area of the platform comprises a concave mesh lining is attached to the rim edge such that as the platform moves upward along the cylinder column in vertical position, material is separated through said mesh lining by size and gravity.

Perhaps the most important quality of this adjustable base system as it relates to the restaurant industry is the fact that each of the three elements of this device are all easily detachable and each having all exposed edges with no hidden grooves or enclosed hollow spaces. The platform is simply a threaded disc. The first surrounding wall is simply a threaded open container. The key element is simply an open tube. Each element may be removed from each other and placed on a wash and dry rack of standard dish washing machines at restaurants, complying with FDA standard over food service regulations. The device may achieve regulatory sanitary standards by simple spray, soaking and drying method on an open platform without additional handling. This is a valuable quality for industries subject to higher regulatory standards concerning sanitation, allowing the standards to be met with minimal effort or handling. Unlike the prior art in the related industry as described above, each separate element of this device may be molded with no assembly of spare parts required. This enables a manufacturing process that can achieve a higher level of sanitary standard from start to finish including the packaging process.

The device and system of this invention is also ergonomically friendly in that the system may be intuitively understood by a person with little to no technical background. The rotating feature of this device eliminates need for a handle feature. A simple grooved tab or button may be located at the top surface of the second surrounding wall, accessible for a person's finger to touch and push to rotate. This feature may be helpful but not necessary to actuate the rotating key to adjust the platform. The rotating key solves the problem of handle protrusions in the space above the container which otherwise would get in the way where food is being served. It also solves another problem in that the entire surface area within the central area of the platform is fully available and the cavity space within the container is unobstructed by unwanted attachments or accessories.

The platform of this device may take many varieties of embodiments. The platform of this invention interfaces and interact the most with the products held therein. As such, this particular element of the invention has mutable value and capability in its ability to change the form and manner of interaction with those products. The platform may take a wide variety of embodiments to fit the variety of needs within the paradigm of this invention. The paradigm of this invention comprising a system wherein a product is placed inside a container, the container having a rotating adjustable base, and the product is manipulated therein.

The platform in its simplest form may comprise a planar disc, functioning as an adjustable bottom base of a container. Food held thereon may simply be raised or lowered with the adjustment of the platform. If the container has a fixed base at its bottom, the planar disc platform may be placed above material contained therein such that when the platform is rotated downward compressing the material, shaping and molding may occur.

Alternatively, the central area may comprise a concave mesh for separation of solid material by size and gravity. In this case, the container would have a fixed bottom base and the platform would be a separate adjustable element located centrally within the cavity of the container. This embodiment having a central concave mesh may have popular application in the self service food industry involving the food comprising solid and liquid products such as soups or stews. In these cases, the mesh would consolidate the solid food product from the liquid without complete separation of the two, allowing the user to find and scoop the solid products away from the liquid with minimal stirring, otherwise damaging the integrity of the solid material by traditional stir and scoop method.

In yet another embodiment, the tube is comprised of two divided halves along its length that may be attached together and locked in place to form an enclosed tube. The platform may comprise a planar central space with a central slicing element (i.e. metal wire or razors) with the sharp edge of the element facing at an angled planar direction and a slit to allow material to flow through said sharp edge to the opposite side of the platform. Dense material may be placed within the tube wherein the platform would be rotated by the rotating key resulting in a spiral cut of the material therein.

Once the cut is completed, the tube halves may be unlocked and opened to find a continuous spiral ribbon of material.

Yet another embodiment may comprise of a solid planar platform wherein the central area having perforations of any type of cross sectional shape. As with the above razor embodiment, compression of the platform against a soft dense material therein forces the material through the perforations, extruding noodle like ribbons with molded cross sectional shape in a spiral like extruded manner.

The first surrounding wall of this invention may not be limited to a cylindrical shape. It may easily be square, rectangular, triangular, etc. The important function of this piece requires a surrounding wall in the form of a column of tube having an internal surface that is threaded in a rotational manner at its cross section and lengthwise to allow threaded movement to travel along the length of the column. The platform itself as it regards the shape of the central perimeter need not be circular so long as the protrusion rotates along a circular perimeter and the ends of the protrusion (defining the diameter or width of the rim of the platform) is in continual contact with the internal surface threading of the first surrounding wall to keep the platform in place at all times and allows it to rotate along the length of the column with the rotation of the rotating key.

The rotating key element itself need not be circular in form so long as it fits within the internal cavity of the first surrounding wall, rotate in a circular pattern within said wall, and where one or more protrusion extends far enough outward to enable the platform to be in continual contact with the threading of the first surrounding wall. Where the two surrounding walls are not cylindrical in shape (i.e. square, triangular, etc.), more than one protrusion may be required wherein each protrusion having a different length to accommodate the nonsymmetrical distances between the protrusion and the first surrounding wall as the platform is being rotated. In this embodiment, each protrusion would be in contact with the threading of the first surrounding wall part of the time, but the platform would always be in contact with the threading of the first surrounding wall with anyone protrusion all of the time.

The ideal or preferred embodiment of this invention would be in cylindrical form wherein both first and second surrounding walls are circular in shape to form two nested cylindrical tubes. This is an ideal embodiment because there would be no gaps or waste of space within the cavity between the three elements. Each element in this form would fit flushly against the internal surface of the other such that a maximum usable surface area is provided within the container and on the platform. Minimal use of material is required for each unit of available surface area in this embodiment. Lastly, the cylindrical feature of this embodiment is most space conserving and adaptable when sharing space with other devices or products on a given surface.

As illustrated in this disclosure, the potential application and use arising from the inherent qualities of this device, system and method of use is open to imagination, but would all be within the intention and spirit of the claims and disclosures of this invention.

DETAILED DESCRIPTION OF THE PREFERRED EMBODIMENTS

Reference will now be made in detail to exemplary aspects of the present invention which are illustrated in the accompanying drawings. Wherever possible, the same reference numbers will be used throughout the drawings to refer to the same or like parts.

Figure 1:
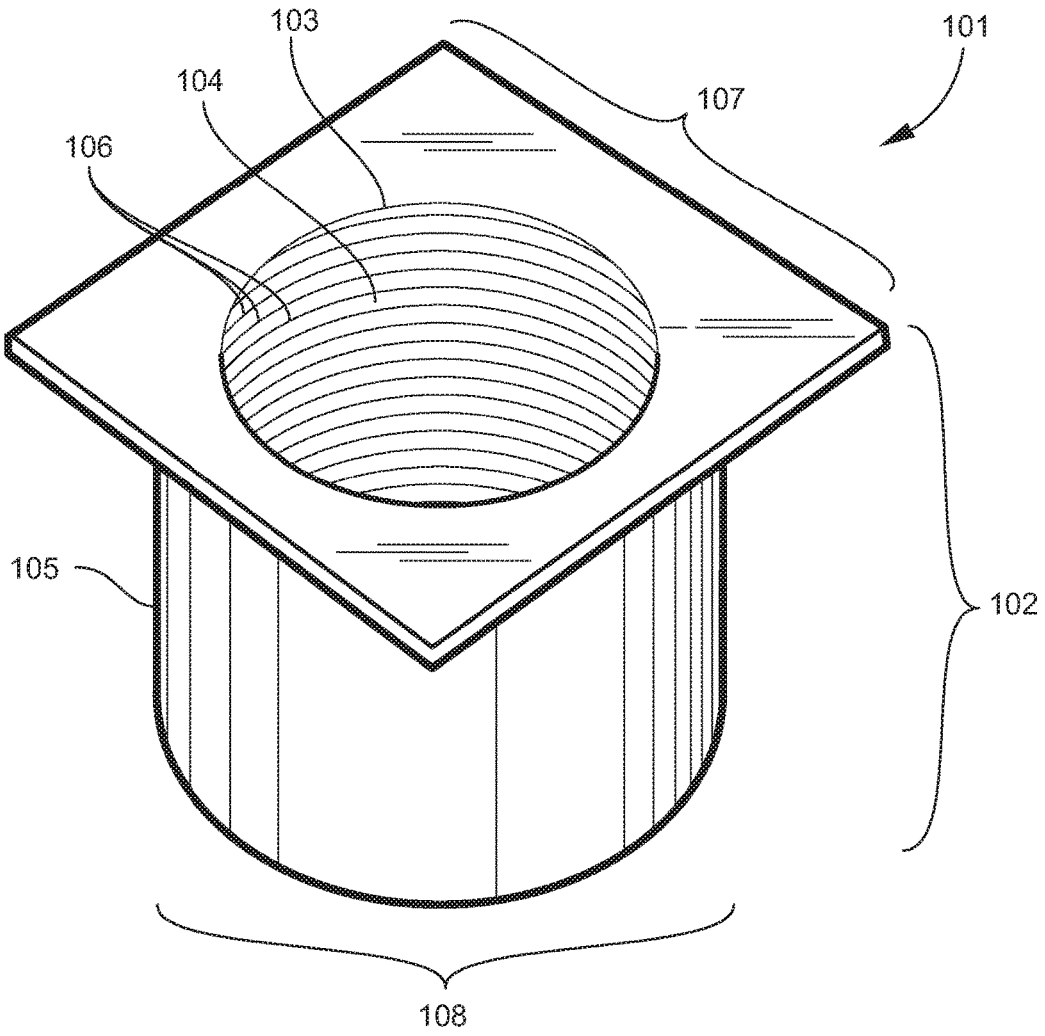
FIG. 1 is a side perspective view of an exemplary embodiment of the invention herein relating to a first surrounding side wall.

FIG. 1 provides a general embodiment for part of the device, specifically here the first surrounding wall 101. The first surrounding wall according to this generalized embodiment being cylindrical in shape along its hollow column 102. However, it need not necessarily be cylindrical to function according to the method and system claimed herein. As provided in the disclosure, the first surrounding wall has an inner surface 103 facing the hollow inner cavity 104 and an outer surface 105 facing the external ambient environment. The inner surface 104 is threaded 106 around its perimeter extending lengthwise along the column 102 to allow upward and downward rotation along the length of the column 102. The threading may be wide or narrow, depending on the speed and fine adjustment of movement sought to be achieved. The first surrounding wall 101 having a top end 107 extending outward from the hollow column 102 forming a square lip and a bottom end 108 which may or may not be capped. The first surrounding wall 101 essentially forming a hollow tube with inner threading.

Figure 2:
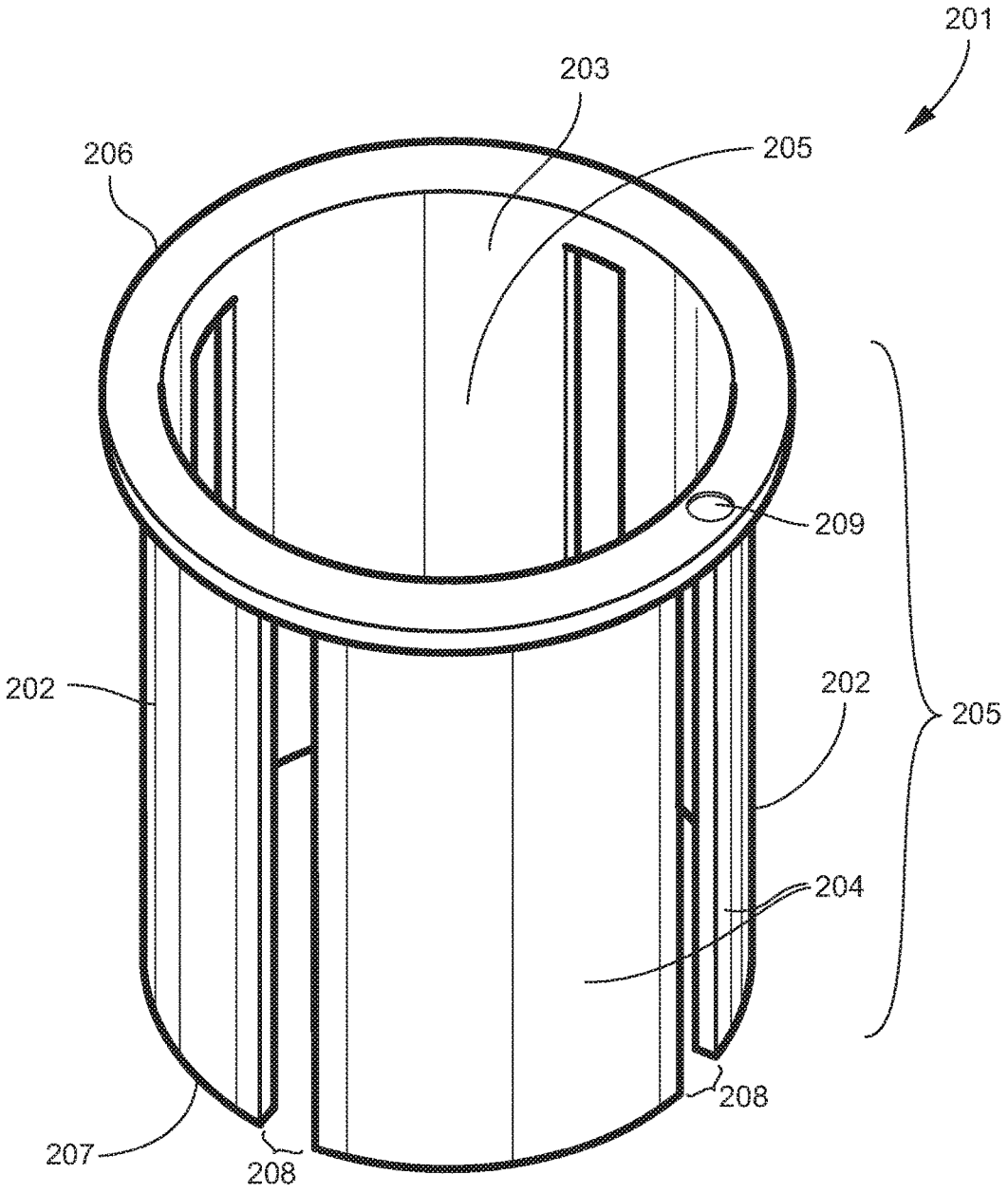
FIG. 2 is a side perspective view of an exemplary embodiment of the invention herein relating to a second surrounding side wall.

FIG. 2 is an illustration of a generalized embodiment of the invention herein, specifically pertaining to the second surrounding wall 201. In this illustration, the second surrounding wall 201 comprising an enclosed wall surface 202. The wall surface of the second surrounding wall having a inner surface 203 and an outer surface 204. The surrounding wall forms a hollow cavity column 205 with a top end 206 and a bottom end 207. The top end 206 and bottom end 207 may be capped although not necessarily so to be functional according to this claimed invention. The second surrounding wall 201 has at least one or more slit openings 208 along its length 205 to accommodate the protrusion of the platform. According to this embodiment, the slit openings 208 are cut and slit all the way through the bottom end 207 of the second surrounding wall 201. An alternative embodiment may have the platform and protrusion sleeved through the slit openings 208 but permanently maintained therein where the slit opening 208 is not cut all the way through to the bottom end 207 of the second surrounding wall 201. This may be helpful to prevent the platform from traveling past the very bottom end 207 of the container if so desired. It would also eliminate an extra step of assembly in that the second surrounding wall 201 containing the platform, being preassembled together as a unit, would be positioned over and rotated onto the first surrounding wall as the initial and only step of assembly. The drawback of this alternative embodiment is the introduction of hidden unexposed surfaces affecting FDA approval.

Yet another embodiment of the slit opening may provide for multiple slit openings of varying lengths of said opening along the second cylinder wall. Where the device comprises a cylindrical shaped first and second surrounding wall such that only one protrusion from the platform is necessary to enable this embodiment, the various lengths of slit openings serves as optional key features that determine and limited the distance of travel by the platform along the length of a tube without need for guessing by a user. The user would sleeve their choice length of slit opening over the protrusion for a desired effect.

An accessory element introduced in FIG. 2 is a small groove 209 embedded at the top end 206 of the second surrounding wall 201 according this embodiment to allow a person's finger to be comfortably placed therein and to push the second surrounding wall in a dialing motion towards a clockwise or counterclockwise direction. This groove 209 serves as lever assistance for ergonomic ease. The lever feature 209 is not necessary for the function of this device, system and method so long as the user is able to dial the second surrounding wall 201 while it is nested within the container system. The lever feature 209 is helpful to enable a better manual leverage and grip. It could alternatively take the form of a wrap around traction grip, a small protrusion or a molded handle. Even more, the rotational movement of the second surrounding wall 201 may be automated by mechanized means according to known methods in the art.

Figure 3:
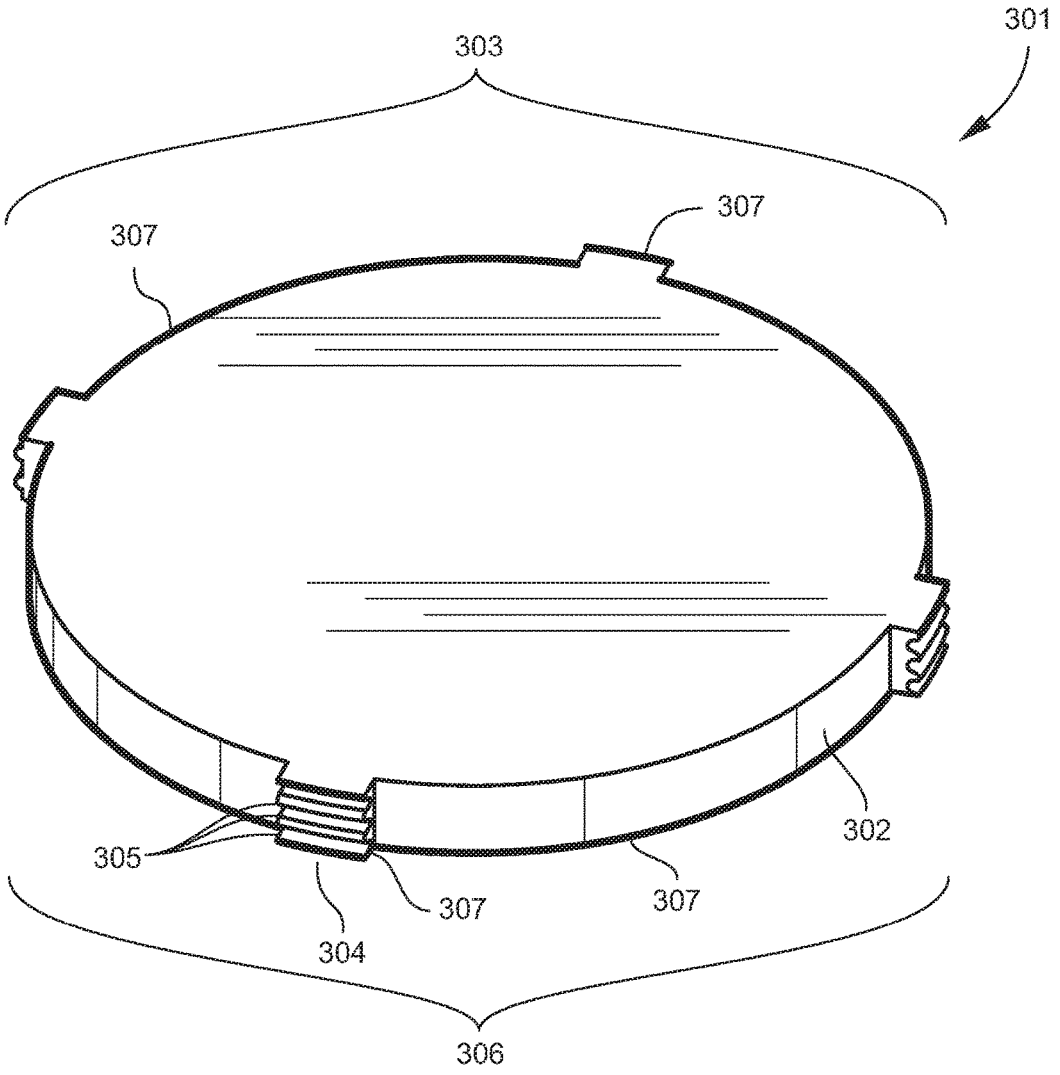
FIG. 3 is a top perspective view of an exemplary embodiment of the invention herein relating to a platform.

FIG. 3 is an illustration of a generalized embodiment of the invention herein, specifically pertaining to the platform 301. The platform 301, according to this general embodiment, comprises a planar piece of material 302 having a top and bottom surface, a central area 303, a rim edge 306 and protrusions 304. The ends of the protrusions are threaded 305 to match and interlock with the threading of the first surrounding wall. The rim edge 306 of the platform 301 comprises the outer most edge 307 of the platform including the protrusion 304. There is no exact line where the rim edge 306 begins and ends within the central space 303 of the platform 301, except that the central space 303 of the platform 301 essentially defines where the usable interfacing space of the platform 301 and fits within the internal hollow space of the second surrounding wall. The rim edge on contrast, extends beyond the central space through the slit openings to contact the first surrounding wall. Where the platform 301 comprises a central concave mesh, the point of attachment of the mesh to the edge of the platform 301 may define where the rim edge 304 begins and ends internally according to where the functional interfacing space begins and ends on the platform. The rim edge 303, according to this example, would serve a secondary function of holding the central interfacing piece of material in place and along the threaded column of the first surrounding wall. Depending on the symmetry of space between the threaded end 305 of the protrusion 304 and the threaded inner surface of the first surrounding wall, the minimum number of protrusion 304 necessary to enable this invention may vary in order to ensure the platform remains in continual contact with the threaded inner surface of the first surrounding wall.

Figure 4:
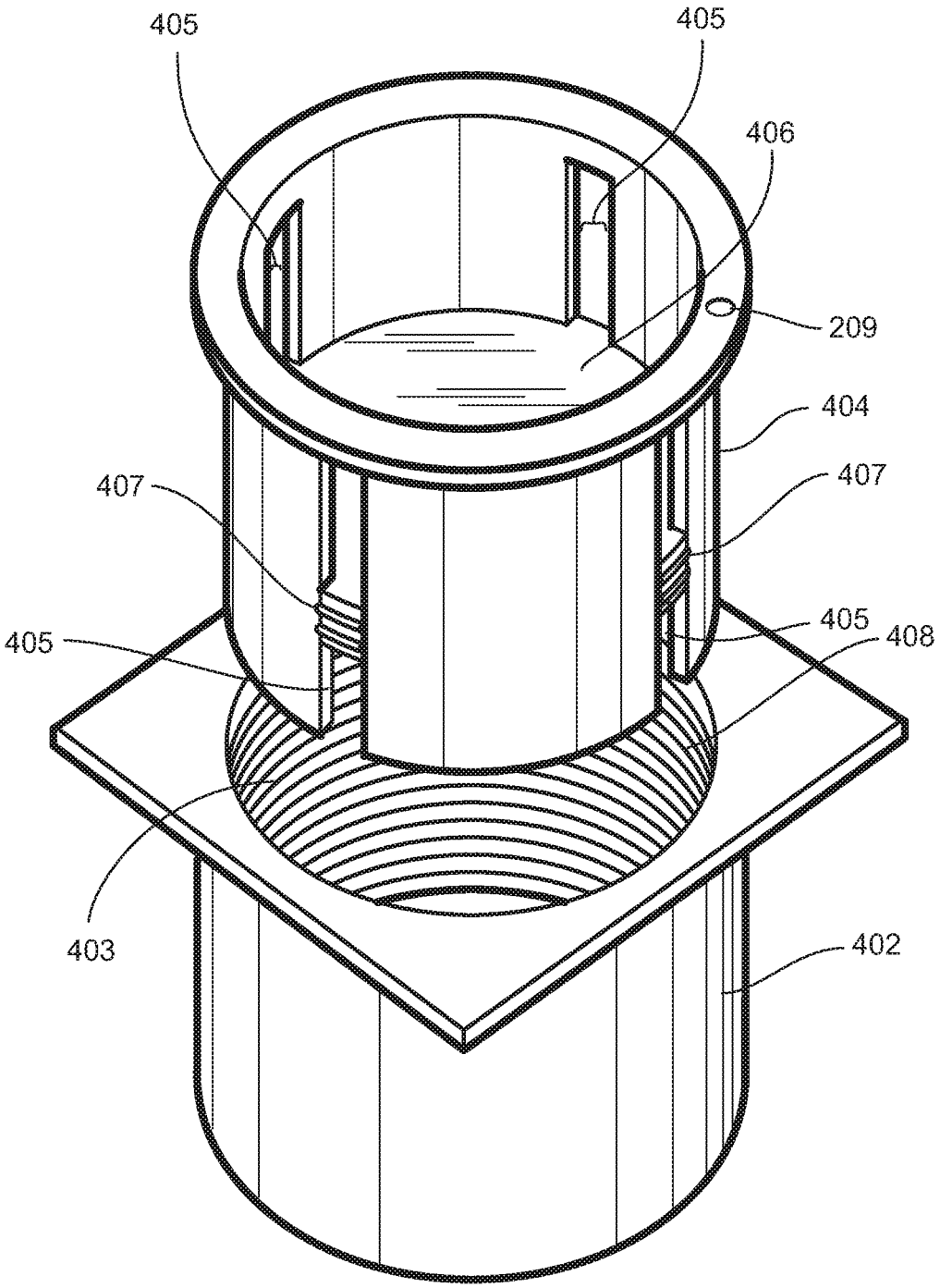
FIG. 4 is a side perspective of an exemplary embodiment of the invention herein.

FIG. 4 is an illustration of a generalized embodiment of the invention illustrating core components of the system and general manner of use. According to FIG. 4, the device and system comprises three core components. The first component is a first surrounding wall 402 that is threaded 408 in its inner surface 403, as shown and described above for FIG. 1. The second component is a second surrounding wall 404 with slit openings 405 as shown and described above for FIG. 2. The third component is a platform 406 with threaded protrusions 407 as shown and described above for FIG. 3. The system herein provides the three components wherein the slit openings 405 of the second surrounding wall 404 are sleeved over the protrusions 407 of the platform 406. These two components are nested within the first surrounding wall 402 wherein the protrusions 407 of the platform 406 are threaded into the matching threading 408 of the first surrounding wall 402. The second surrounding wall 404 is nested within and between the first surrounding wall 402 and the platform 406. By rotating or dialing the second surrounding wall 402 clockwise or counterclockwise, the slit opening 405 moves the protrusion 407 in the same direction, causing the platform to rotate along its threaded connection either upward or downward along the length of the container column. According to one embodiment of this invention as provided in the illustration of FIGS. 2 and 4, the slit opening 405 is cut all the way through the bottom end of the second surrounding wall 404.

Whether or not the slit opening 405 is closed or open at the bottom end of the second surrounding wall 404 dictates number of steps of assembly, though not altering how it functions according to the claim. According to the embodiment of FIG. 4, the user would connect the threading of the platform 407 to the threading 408 of the first surrounding wall 402, sleeve the slit opening 405 over and through the protrusion 407 and finally rotate the second surrounding wall 404 to cause the platform 406 to move downward to a choice position within the container column. This is a three step assembly process. Alternatively, the bottom end would be closed with the platform 404 permanently retained therein by the protrusions 407 loosely floating within the slotted slit opening 405. In this alternative example, the two piece unit would be placed overtop the first surrounding wall 402 and rotated to establish a threaded connection. This alternatively provides a two step assembly.

Having fully described at least one embodiment of the present invention, other equivalent or alternative methods according to the present invention will be apparent to those skilled in the art. The invention has been described by way of summary, detailed description and illustration. The specific embodiments disclosed in the above drawings are not intended to be limiting. Implementations of the present invention with various different configurations are contemplated as within the scope of the present invention. The invention is thus to cover all modifications, equivalents, and alternatives falling within the spirit and scope of the following claims.

We claim:

1. An adjustable base containment system consisting essentially of a first cylinder, a platform having protrusions and being a solid disc, and a second cylinder having slit opening along its length extending completely through a bottom end in an axial direction, said platform is positioned within said first cylinder, said slit opening of said second cylinder is sleeved over said protrusions of said platform whereby said second cylinder is nested between said platform and said first cylinder, said platform is interconnected to said first cylinder by matching reverse threading at the contacting surfaces of said protrusion and said first cylinder, the position of said platform within said container may be raised or lowered by clockwise or counterclockwise rotation of said second cylinder causing said platform to move against said first cylinder along their threaded connection.

2. The adjustable base containment system of claim 1, further comprising a control element externally accessible from the cross sectional surface of said second cylinder, said control element comprising a recessed or hidden leverage point accessible by a user's finger to achieve a rotational dialing motion of said second cylinder wall.

3. An adjustable base container consisting essentially of:
A hollow container, a platform and a key element,
said hollow container comprising a first surrounding wall and a hollow internal space therein, said first surrounding wall having an internal surface and external surface, said internal surface being threaded lengthwise, said key element comprising a second surrounding wall, said second surrounding wall fitting within said first surrounding wall, said second surrounding wall having an internal surface and external surface, said external surface of said second surrounding wall facing said internal surface of said first surrounding wall, said internal surface of said second surrounding wall facing said hollow internal space, said second surrounding wall having slit openings along its length extending completely through a bottom end in an axial direction, said platform having a top and bottom surface, a central space and a rim edge and being a solid disc, the diameter of said central space being equal to or less than the cross sectional space of the hollow internal space within the second surrounding wall, said platform having a rim edge at its furthest edge in contact with the first and second surrounding wall, said platform further having protrusions extending laterally from its rim edge, said rim edge having a surrounding side surface perpendicular to said top surface of said platform, said surrounding side surface at the location of said protrusions being threaded lengthwise matching said threading of said first surrounding wall in an interconnecting manner.

4. The adjustable base container of claim 3, wherein said first surrounding wall is cylindrical in form and said second surrounding wall is cylindrical in form.

5. The adjustable base container of claim 3, wherein said central space of said platform comprises a planar piece of material.

* * * * *